United States Patent [19]

Reid

[11] Patent Number: 4,802,640

[45] Date of Patent: Feb. 7, 1989

[54] OBLIQUE AXIS SEEKER

[75] Inventor: James B. Reid, Phoenix, Ariz.

[73] Assignee: Motorola, Inc., Schaumburg, Ill.

[21] Appl. No.: 943,598

[22] Filed: Sep. 18, 1978

[51] Int. Cl.[4] ..... F41G 7/00; F42B 15/02; G06F 15/50

[52] U.S. Cl. ..... 244/3.19; 343/765; 343/766

[58] Field of Search ..... 244/3.19, 3.2, 3.21; 343/757, 759, 763, 765, 766

[56] References Cited

U.S. PATENT DOCUMENTS 3,084,340 4/1963 Stout et al. ..... 244/3.19
3,407,404 10/1968 Cook et al. ..... 343/765

OTHER PUBLICATIONS

Delany et al., *Radar Antenna Stabilization on Naval Ships by a Tilted Axis Configuration,* IEEE Mechanical Engineering in Radar, pp. 163–168, Nov. 1977.

*Primary Examiner*—Theodore M. Blum
*Attorney, Agent, or Firm*—Maurice J. Jones

[57] ABSTRACT

A mechanical seeker for use in guided missiles utilizes two axes of rotation which are non-orthogonal to each other and to the longitudinal axis of the missile, and which converge at a point coincident with the center of mass of the antenna. This combination allows wide look angles of plus and minus 45 degrees or greater in a small envelope on the order of 5 inches or less in diameter.

8 Claims, 2 Drawing Sheets

OBLIQUE AXIS SEEKER

BACKGROUND OF THE INVENTION

This invention relates to mechanical seekers, and more particularly, to seekers used in airborne guided missiles.

A guided missile, particularly an air-to-air guided missile, requires a high performance seeker assembly to manuever a radar antenna in the nose of the missile. The severest demands placed on the seeker involve moving the antenna through a wide look angle, maneuvering the antenna in the presence of high G forces, and combining the seeker functions into a small diameter envelope on the order of 5 inches. Also of prime importance is the reliability of the seeker and the cost of the seeker.

Previous orthogonal axis seekers have generally not been able to provide the wide look angles in a small envelope required by state of the art guided missiles. Moreover the offset required of the two orthogonal axes (i.e., the axes do not intersect) produces severe torque requirements on the drive motors due to high lateral G environments. For instance a lateral force of 120 G's causes a five ounce antenna to place a 37.5 pound static load on the bearings and the motors.

Moreover, an orthogonal axes seeker restricts the motors to a limited back and forth motion thereby producing increased torque requirements on the motors.

Therefore it can be appreciated that a reliable guided missile seeker which provides wide look angles in a small envelope yet which is fairly simple in construction is highly desirable.

SUMMARY OF THE INVENTION

It is therefore an object of this invention to provide a guided missile seeker which is relatively simple in construction.

It is also an object of this invention to provide a seeker which has a look angle of ±45 degrees or greater.

It is also an object of this invention to provide a seeker for a guided missile which will operate in an envelope of 5 inches in diameter.

It is still another object of this invention to provide a seeker for a guided missile wherein all axes of motion intersect at a common point.

It is also an object of this invention to provide a seeker for a guided missile wherein the driving motors can rotate continuously about each axis of rotation.

It is still another object of this invention to provide a seeker for a guided missile which utilizes wide diameter anti-friction bearings to withstand high G forces.

An illustrated embodiment of the invention provides a seeker for use in a guided missile having a longitudinal axis which comprises a first driven member having a first axis of rotation lying at an oblique angle to the longitudinal axis of the missile and being rotatively coupled to the body of the missile, and a second driven member having a second axis of rotation lying at an oblique angle to the longitudinal axis of the missile and being rotatively coupled to the first member, and an antenna mounted to the second member and having its center of mass at the approximate coincidence of the longitudinal axis of the missile, the first axis and the second axis.

DETAILED DESCRIPTION OF THE PREFERRED EMBODIMENTS

Figure 1:
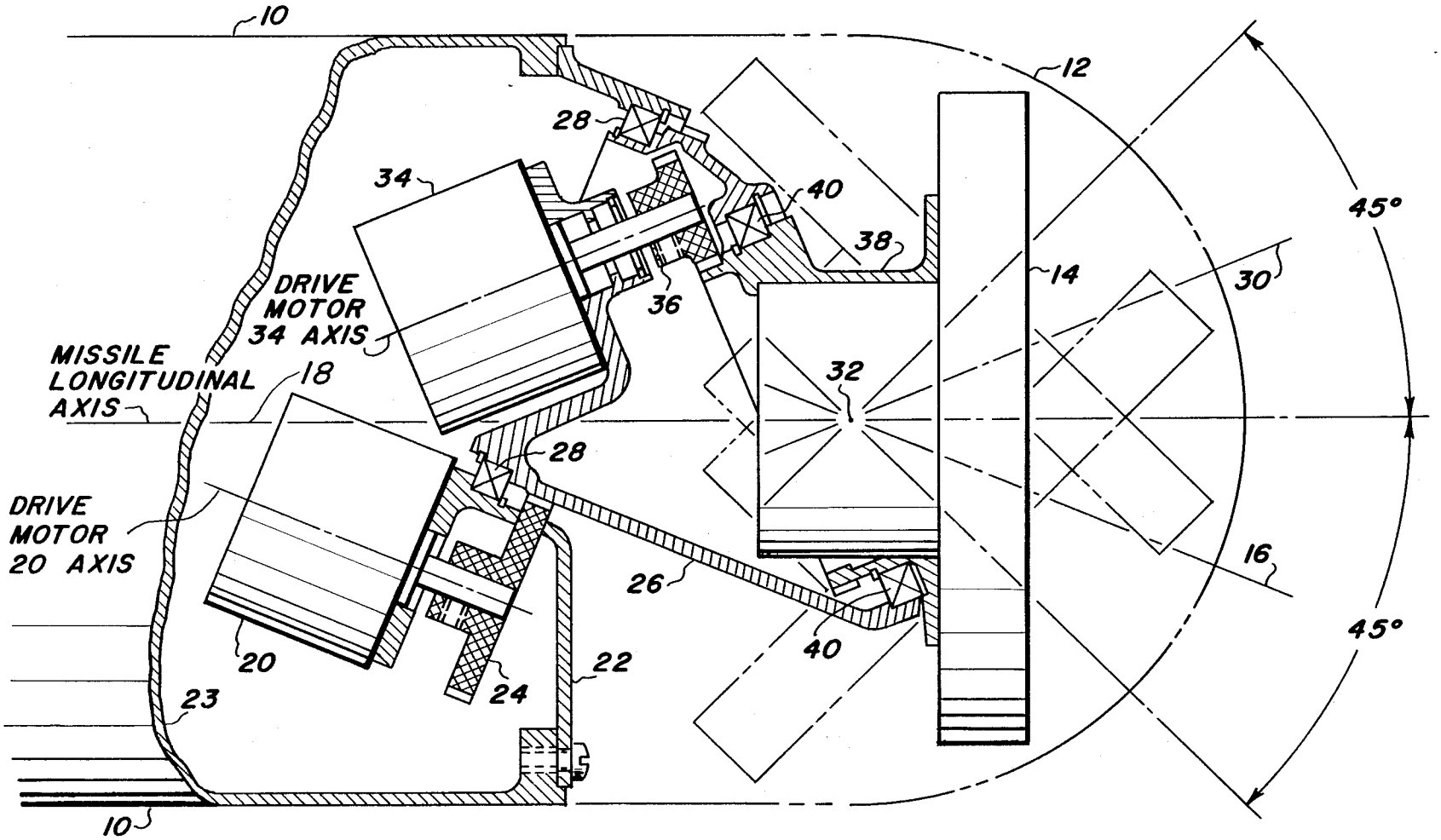
FIG. 1 is a cross-sectional side view of an oblique axis seeker housed in a missile.

Now referring to FIG. 1 a cross-section of an oblique axis seeker having two axes of motion is shown mounted inside a missile body 10 with a radome 12 covering the antenna structure 14 which in turn is supported by the oblique axis seeker. A first axis of the seeker is shown as broken line 16 lying at an angle of 22½ degrees from the longitudinal axis or roll axis 18 of the missile. A drive motor 20 has its outer casing secured to the body of the missile by bracket 22 which in turn is secured to cylindrical element 23. The rotor of motor 20 drives the gear 24 which in turn engages a trunnion tube 26 which rotates about axis 16 and is supported by a ring bearing 28. A second axis of motion having an axis indicated by dotted line 30 is also oblique to the longitudinal axis of the missile 18 at an angle of 22.5 degrees and forms an angle of 45 degrees with first axis 16. First axis 16, second axis 30, and longitudinal axis 18 all intersect at a point 32 which is the center of mass of antenna 14. In this manner the load is balanced about each axis (18, 16 and 30) and the motors do not support a static unbalance load.

A trunnion tube 26, which has its center of rotation about first axis 16, supports a second drive motor 34. The rotor of drive motor 34 is fixed to gear 36 which in turn engages a mating gear fixed to antenna mounting bracket 38. The antenna mounting bracket 38 rotates about the second axis 30 and in turn is supported by anti-friction bearings 40. The antenna structure 14 is securely mounted to the antenna bracket 38.

In operation drive motor 34 turns the antenna such that the line of sight of the antenna 14 describes a cone whose included angle is 45 degrees. Drive motor 20, if driven alone (i.e. drive motor 34 held static), will cause the antenna structure 14 to generate a cone whose included angle is 45 degrees. When both motors 20 and 34 are rotating, antenna assembly 14 will generate a cone having an included angle of 90 degrees and an axis along the longitudinal axis 18. It is possible to realize any angle within this cone by proper positioning of drive motors 20 and 34. The position of the antenna structure is readily determined using standard calculus axis transformation techniques (rotation matrices) to transform the oblique axis positions to standard orthogonal axis notation.

The seeker structure is characterized by three short, large diameter, thin walled cantilever cylinders 23, 26, and 38. The cylinders are series connected with the largest 23 fixed to the missile 10 and the smallest 38 fixed to the antenna structure 14. Connections between adjacent cylinders are by large diameter, small cross-section, torque-tube type ball bearings 28 and 40. These bearings may be duplexed as the structure analysis requires it. Electrical conductor routing can take advantage of tube center line positioning which requires no change of wire length as a function of antenna angular position. The electrical connections can be hard wired if the drive motors 20 and 34 do not rotate completely but rather oscillate, or can be through commutator rings if the drive motors 20 and 34 are allowed to rotate continuously. The complete seeker structure consists of one fixed and two moveable cylinders, 23 and 26, 38 respectively, connected by two (or four if duplex) bearings and two drive motors 20 and 34. The small quantity of parts along with their large sizes relative to the missile body size produces a simple, low cost seeker.

Figure 2:
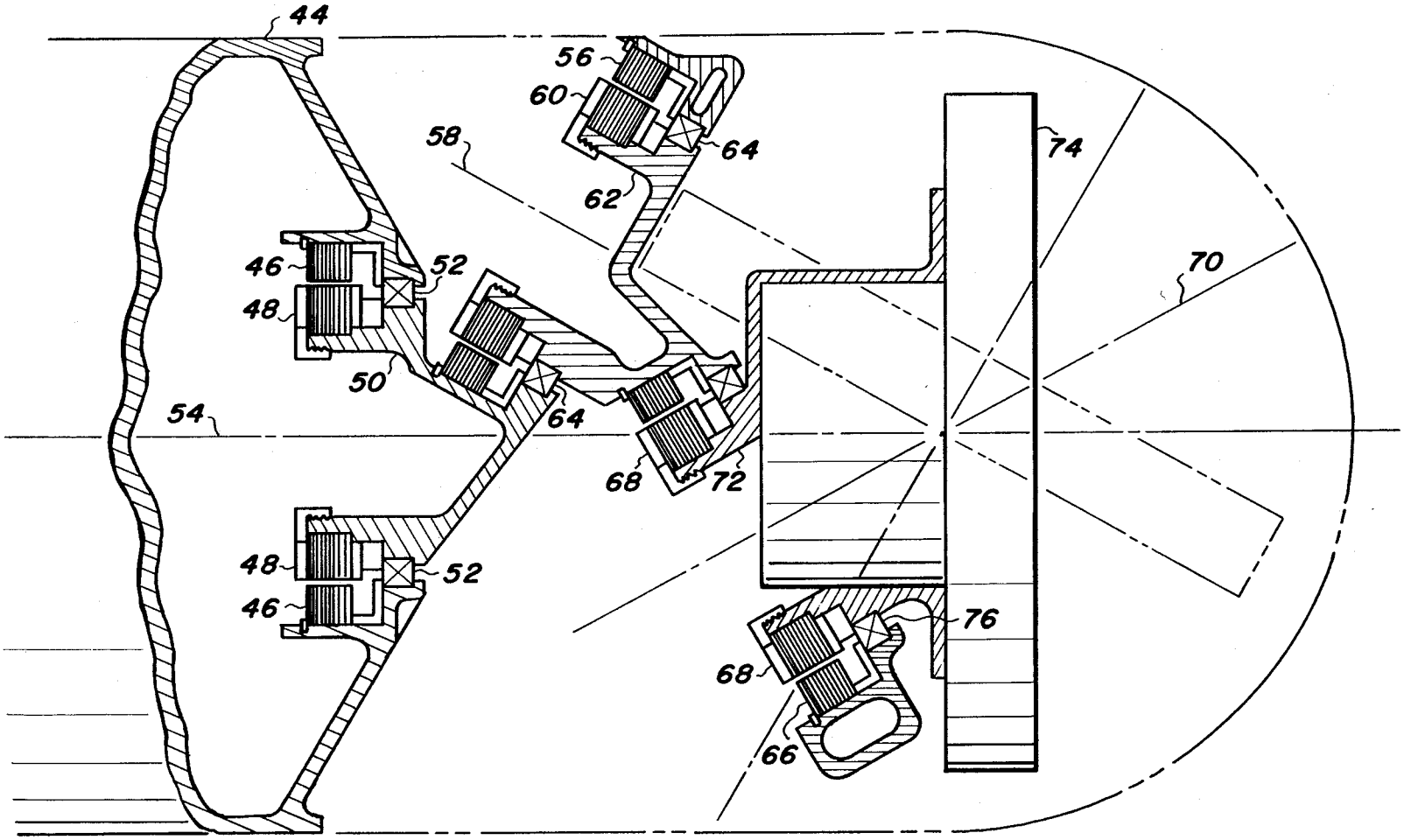
FIG. 2 is a cross-section of an alternate embodiment of the oblique axis seeker.

A second embodiment of the oblique axis seeker showing a seeker having three axes of motion is shown in FIG. 2. A mounting cylinder 44 supports a stator 46 of a pancake motor, the rotor 48 of which is attached to a second cylinder structure 50 which is supported by bearing 52 which in turn is supported by the mounting cylinder 44. The inner cylinder 50 has an axis of rotation coincident with the longitudinal axis or roll axis 54 of the missile. Mounted to the inner cylinder is a stator 56 of a second pancake motor which is mounted in an oblique angle to form a second axis having a center line shown by broken line 58. Stator 56 of the second motor has associated with it a rotor 60 which in turn is supported by a third cylindrical member 62. Bearing 64 forms a support between the cylindrical member 50 and the cylindrical member 62. A third pancake motor is mounted on cylindrical member 62 having a stator 66 and associated rotor 68. The third pancake motor is aligned around an oblique axis shown by dotted line 70. The rotor 68 is mounted inside a fourth cylindrical member 72 which in turn supports the antenna assembly 74 and in turn is supported on bearing 76 the race of which is mounted to the cylindrical member 62. The oblique axes 58 and 70 in the preferred embodiment are aligned in an angle of 30 degrees from the longitudinal axis 54.

The operation of the motors around the two oblique axes 58 and 70 and the resulting direction of the antenna element 74 is exactly as that described in regard to FIG. 1. However the second embodiment utilizes an additional motor to the two shown in FIG. 1. This additional motor shown as stator 46 and rotor 48 is aligned with the longitudinal axis 54 of the missile and operates to rotate the total assembly shown in FIG. 1 about the missile roll axis. This configuration has the added advantage of being able to cancel approximately any roll in the missile itself as it is travelling towards the target. Also the conventional motors of FIG. 1 have been replaced by flat pancake motors such as the Magtec 2375-050 torque motor. These motors have the advantage of being less voluminous and having a center of mass lying on the axis of rotation. Again in this configuration all three of the axes of rotation have a common point which is approximately at the center of mass of the antenna assembly 74. Note that these motors are also direct drive motors as opposed to the gear and shaft motors of FIG. 1.

While the invention has been particularly shown and described with reference to the preferred embodiment shown, it will be understood by those skilled in the art that various changes may be made therein without departing from the teachings of the invention. Therefore, it is intended in the appended claims to cover all such equivalent variations as come within the scope and spirit of the invention.

What is claimed is:

1. A platform translator mechanism for moving a platform with respect to a mounting body in a vehicle, said vehicle having a direction of motion along a longitudinal axis, comprising:

(a) a first connecting member having a first portion and a second portion, said first portion being rotatable with respect to said second portion about a first axis, said first portion being attached to the mounting body;

(b) a second connecting member having a first segment and a second segment, said first segment being rotatable with respect to said second segment about a second axis, said first segment being attached to said second portion, said second segment being attached to the platform; and (c) said first axis and said second axis intersecting at an oblique angle and at a point approximately coincident with the center of gravity of the platform and each of said first axis and said second axis being at an oblique angle with respect to the longitudinal motion axis.

2. A seeker for use in a missile having a longitudinal axis comprising:

(a) a first driven member having a first axis of rotation lying at an oblique angle to the longitudinal axis being rotatively coupled to the body of the missile;

(b) a second driven member having a second axis of rotation lying at an oblique angle to the longitudinal axis of the missile and being rotatively coupled to said first driven member;

(c) an antenna assembly mounted to said second driven member and having its center of mass at the approximate coincidence of the longitudinal axis, said first axis and said second axis.

3. A seeker as set forth in claim 2 wherein said first axis and said second axis are at an angle of approximately 22.5 degrees from the longitudinal axis of the missile.

4. A seeker as set forth in claim 2 wherein said first driven member and said second driven member are driven by pancake motors.

5. A seeker as set forth in claim 2 wherein said seeker forms a portion of a nose of the missile.

6. A seeker for use in a missile having a longitudinal axis comprising:

(a) a first driven member having a first axis of rotation lying on the longitudinal axis and being rotatively coupled to the missile body;

(b) a second driven member having a second axis of rotation lying at an oblique angle to the longitudinal axis of the missile and being rotatively coupled to said first driven member;

(c) a third driven member having a third axis of rotation lying at an oblique angle to the longitudinal axis of the missile and being rotatively coupled to said second driven member; and (d) an antenna assembly mounted to said third driven member and having its center of mass at the approximate coincidence of the longitudinal axis, said second axis, and said third axis.

7. A seeker as set forth in claim 6 wherein said second axis and said third axis are at an angle of approximately 30 degrees with respect to the longitudinal axis of the missile.

8. A seeker as set forth in claim 6 wherein said first driven member, said second driven member, and said third driven member are driven by pancake motors.

* * * * *